US007134808B2

(12) United States Patent
Albone et al.

(10) Patent No.: US 7,134,808 B2
(45) Date of Patent: Nov. 14, 2006

(54) DRAIN SEALING

(75) Inventors: David Charles Albone, Letchworth (GB); Robert James King, Hitchin (GB)

(73) Assignee: ACO Polymer Products, Inc., Chardon, OH (US)

( * ) Notice: Subject to any disclaimer, the term of this patent is extended or adjusted under 35 U.S.C. 154(b) by 0 days.

(21) Appl. No.: 10/961,325

(22) Filed: Oct. 8, 2004

(65) Prior Publication Data

US 2005/0074294 A1 Apr. 7, 2005

Related U.S. Application Data

(63) Continuation-in-part of application No. 10/857,281, filed on May 28, 2004, now abandoned.

(30) Foreign Application Priority Data

May 30, 2003 (GB) ..... 0312464.1

(51) Int. Cl.
*E01C 11/22* (2006.01)

(52) U.S. Cl. ..... 405/126; 405/118; 405/43; 405/36; 404/2

(58) Field of Classification Search ..... 405/36, 405/43, 44, 46, 47, 49, 118, 124, 126; 138/111–117, 138/173, 177; 404/2–5
See application file for complete search history.

(56) References Cited

U.S. PATENT DOCUMENTS

| | | | | | |
|---|---|---|---|---|---|
| 2,449,731 | A | * | 9/1948 | Therrien | 405/43 |
| 3,225,545 | A | * | 12/1965 | Flegel | 405/43 |
| RE27,732 | E | * | 8/1973 | Buren | 138/177 |
| 4,560,302 | A | | 12/1985 | Karbstein | |
| 4,759,661 | A | * | 7/1988 | Nichols et al. | 405/48 |
| 4,940,359 | A | * | 7/1990 | Van Duyn et al. | 405/118 |
| 5,908,266 | A | * | 6/1999 | Miller | 405/41 |
| 5,971,662 | A | * | 10/1999 | Becker et al. | 405/119 |
| 6,000,881 | A | | 12/1999 | Becker et al. | |
| 6,273,640 | B1 | * | 8/2001 | Suazo | 405/121 |
| 6,386,550 | B1 | * | 5/2002 | Mokrzycki et al. | 405/47 |
| 6,602,023 | B1 | * | 8/2003 | Crescenzi et al. | 405/42 |
| 6,612,777 | B1 | * | 9/2003 | Maestro | 405/49 |
| 6,692,186 | B1 | * | 2/2004 | Suazo et al. | 405/36 |
| 6,905,285 | B1 | * | 6/2005 | Little et al. | 405/36 |

FOREIGN PATENT DOCUMENTS

| | | | | |
|---|---|---|---|---|
| GB | 2261242 | A | 5/1993 | |
| GB | 2347706 | A | 9/2000 | |
| GB | A 2373530 | | 9/2002 | |
| GB | 2390632 | A | 1/2004 | |
| JP | 56061226 | * | 5/1981 | 138/177 |
| JP | 10088650 | | 4/1998 | |

* cited by examiner

*Primary Examiner*—Frederick L. Lagman
(74) *Attorney, Agent, or Firm*—Pearne & Gordon LLP

(57) ABSTRACT

Plastic liner sections define a drainage channel when placed end to end. Each end has a stiff, double walled flange at each side of the end adapted to butt up to a similar flange at the adjacent end of the next sections. The double walled construction of the flanges stiffens the ends significantly reducing the risk of deformation by the hydrostatic forces produced by wet concrete during installation. A groove is formed inwardly of the flanges on a female end of the liner section and receives a sealing ring, which is held in place by a lip formed on a male end.

12 Claims, 2 Drawing Sheets

DRAIN SEALING

RELATED APPLICATIONS

The present application is a continuation-in-part of U.S. Application Ser. No. 10/857,281, entitled "Drain Sealing", filed May 28, 2004, now abandoned, which application claims the priority under 35 U.S.C.§119 on the basis of the following foreign application: United Kingdom Application Serial No. 0312464.1, entitled "Drain Sealing", filed May 30, 2003.

BACKGROUND OF THE INVENTION

1. Field of the Invention

The present invention relates to the sealing of channel drainage systems, and more specifically to the sealing of high capacity channels typically referred to as wide channel drainage systems.

2. Description of Related Art

Robust drainage channels with a high hydraulic capacity are required for surface drainage in large areas such as distribution centres, car parks, airports and farm yards. The water carried in the drains from such surfaces will inevitably carry environmental pollutants such as hydrocarbons, pesticides, organic effluents and milk. It is therefore important to prevent such water from leaking out of the drain into the surrounding sub-soil where it may contaminate ground water supplies and produce other harmful environmental effects such as eutrophication. Natural stormwater leaking from the drainage system into surrounding contaminated land may also disturb and mobilise any latent toxins that may reside in the soil, particularly on brownfield site applications.

Polymer concrete U shaped channel drain sections are typically joined by being butted together end to end to form a channel. These joints are not water tight and the concrete haunch is relied upon to prevent leakage into the surrounding sub-soil. Escaping water may erode and therefore weaken the concrete. Where sealing is required sealing compounds are used.

Zurn Industries, Inc. in U.S. Pat. No. 6,000,881 describes a modular polymeric trench drain system in which the modules act as both former and liner. The Zurn modules define a U shaped channel section terminating in a restricted throat defining a slot drain at the surface. Zurn describes the technical problem of pressure from wet concrete against the trench drain walls causing deformation during installation. Flanges are formed at each end of the modules to facilitate joining of the sections. At one end the flange has a peripheral groove member to form a female section that mates with a male section on an adjacent flange of the next module section. In an alternative embodiment the flanges are omitted and a lip serves as a male section for engaging into a female section that is not illustrated GB-A-2 373 530 (ACO Technologies plc) describes a wide channel drainage system in which plastics channel liner sections each defining a complete pipe section, are connected to form a continuous channel. In that specification it is taught to interlock the channels by means of male and female connection details at opposite ends. However since the sections have no significant structural strength and are lightweight, it has been found that an unacceptable deformation occurs at the weaker, male end of the channel section. This is due to the hydrostatic forces exerted by the wet concrete surrounding the channel section.

Although Zurn acknowledges the technical problem of channel section deformation, the only solution proposed is the provision of clips to allow reinforcing and support rods to be held in horizontal and vertical axes at either side of the sections. This leaves the ends vulnerable.

SUMMARY OF THE INVENTION

The present invention accordingly provides a plastics liner section for defining a drainage chanel when placed end to end, each end having a flange at each side of the end adapted to butt up to a similar flange at the adjacent end of the next section, characterised in that the flanges are each defined by two spaced wall portions joined together by a side wall.

Such double walled flanges are stiffer than the single wall flanges of Zurn and are therefore capable of resisting the concrete forces. The flanges therefore provide a face sealing arrangement as with polymer concrete U shaped channel sections.

A single flange may extend all round a lower part of the end of the section, but the flanges are preferably constructed as separate wings on each side of the end.

Preferably a hollow box section surrounds each end of the liner section in order to provide increased stiffness.

Alignment and sealing of the ends may be facilitated by forming a lip at one end inside the flange and a groove at the other end. This lip and groove are preferably supported on the box section. For sealing purposes the groove may be sized to receive a hollow annular seal, which is retained in place by the lip.

BRIEF DESCRIPTION OF THE DRAWINGS

In order that that invention may be well understood an embodiment thereof will now be described, by way of example only, with references to the accompanying diagrammatic drawings, in which.

DETAILED DESCRIPTION OF INVENTION

Figure 1:
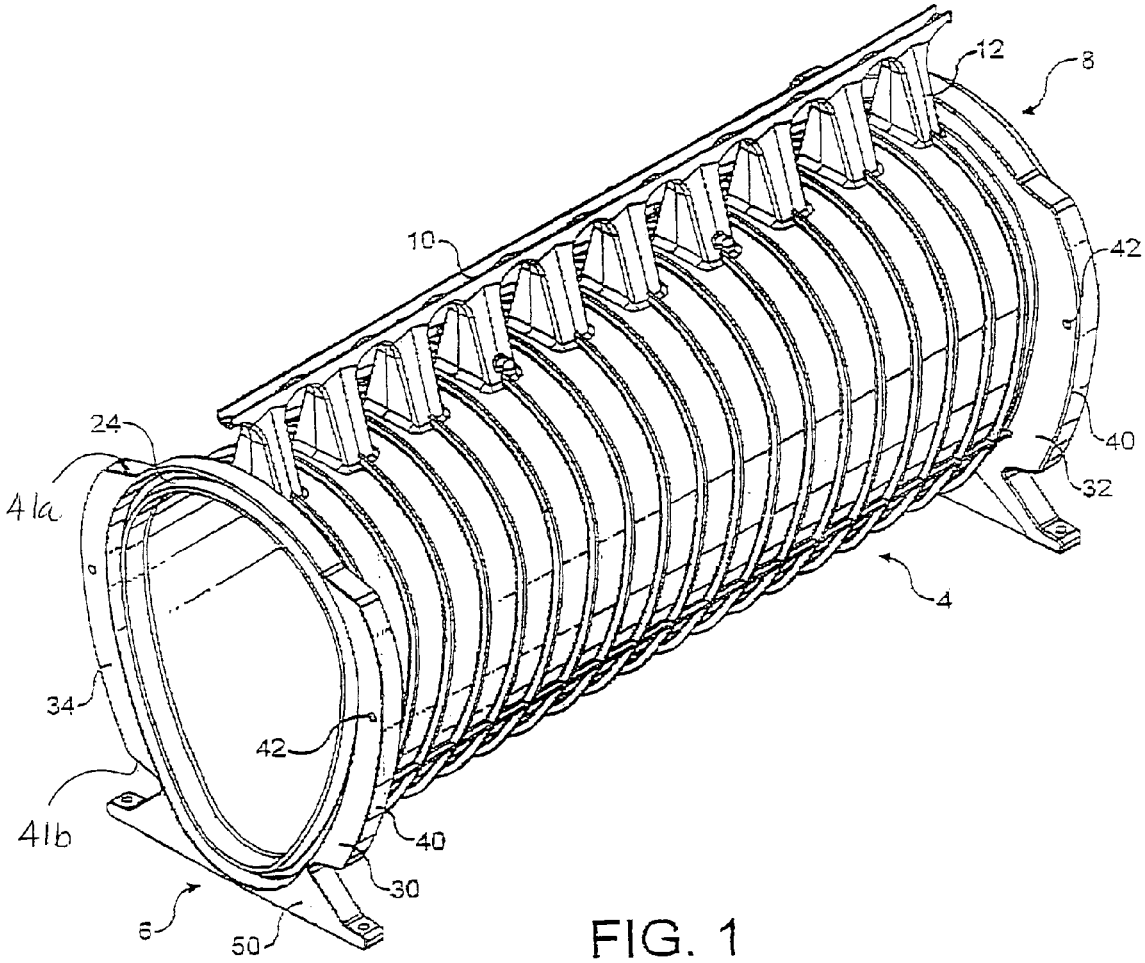
FIG. 1 shows a perspective view of a plastics liner section in accordance with the present invention.
Figure 2:
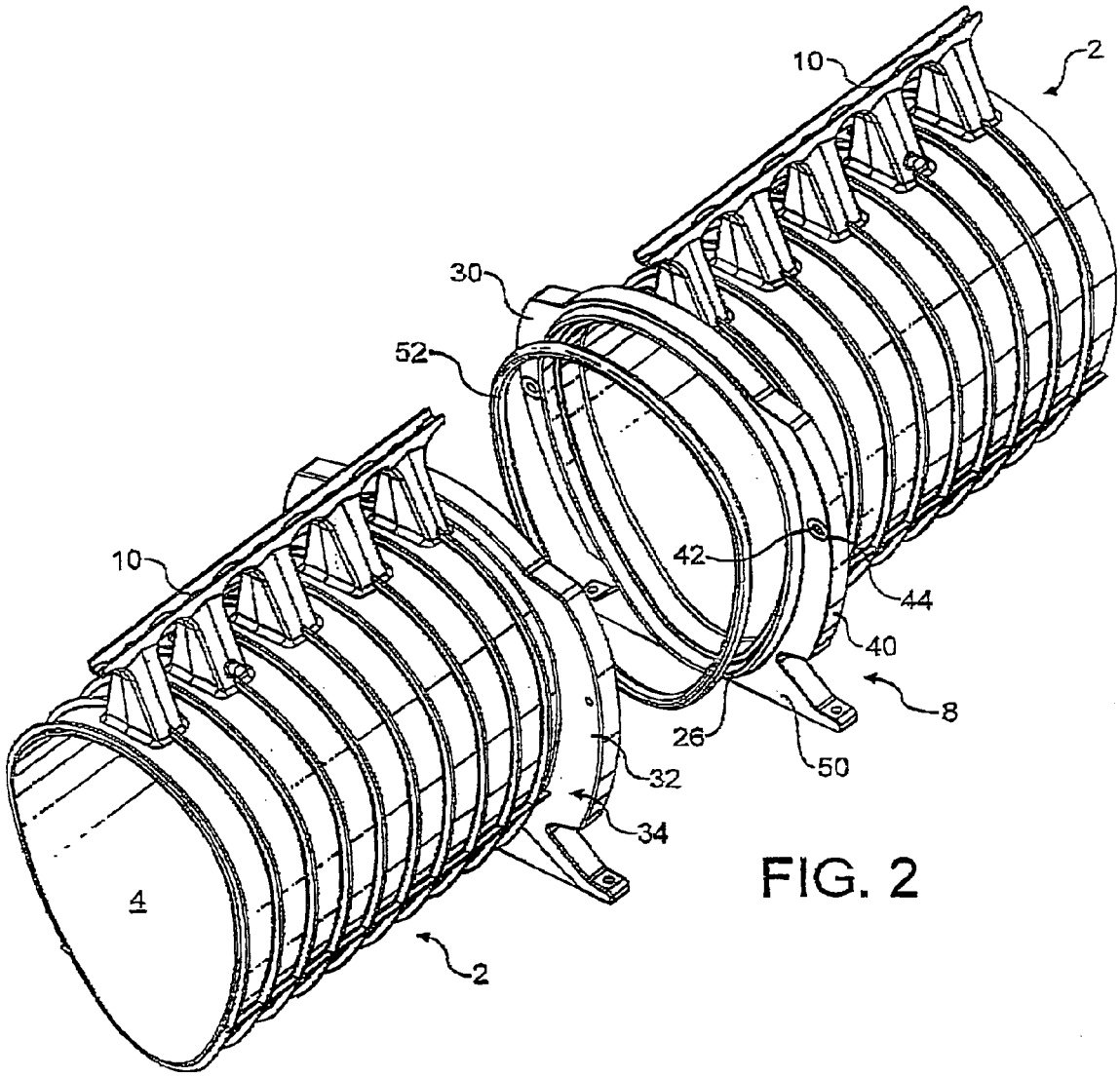
FIG. 2 shows an exploded view of two ends of adjacent liner sections.
Figure 3:
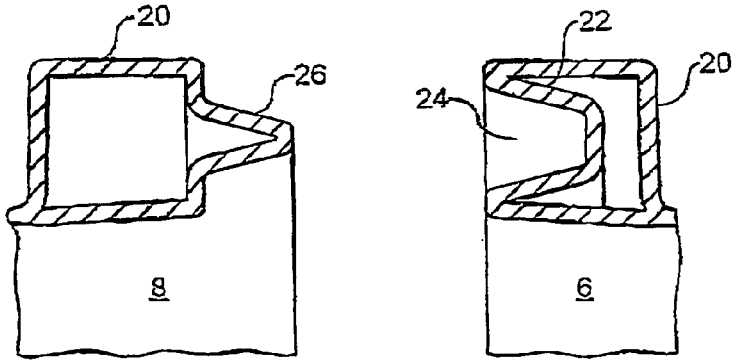
FIG. 3 shows a section through adjacent ends in an upper region between the flanges.

A plastics liner section 2 has a pipe portion 4 open at each end 6, 8. A slot 10 communicates with the pipe portion 4 by means of a series of hollow projections 12.

The liner sections 2 are intended to be placed end 6 to end 8 in order to provide a channel drain. Other features of this liner section 2 are described and claimed in European Patent Application 03 [ ] claiming priority from GB 0215979.6 of 10 Jul. 2002. It will be appreciated that the end structure that is the subject of this application may also be used with other designs of liner section such as those described in Zurn U.S. Pat. No. 6,000,881.

The liner sections 2 may be formed in one piece using rotational moulding. The preferred material is medium density polyethylene (MDPE).

The ends 6 and 8 are stiffened relative to the remainder of the liner section 2 by the use of a double walled construction. A box section 20 surrounds each end 6, 8. At the female end 6 a front face 22 of the box section 20 is indented to provide a deep groove 24. A lip 26 is formed on the box section 20 at the male end 8.

At both ends 6, 8, spaced parallel wall portions 30, 32 project at each side of the open end 6, 8 in order to define flanges like wings 34 on either side of the end. The wall portions 30, 32 are joined together by a side wall 40 so that the wings 34 are hollow and light weight but much stiffer than the remainder of the liner section 2. The wall portions 30, 32 can also be joined together by a first end wall 41*a* and a second end wall 41*b*.

Aligned openings 42 are formed in each of the walls 30 and 32 to enable a screwed fixing (not shown) to pass through both adjacent flanges 34 when they are butted together in order to hold them in position if desired. A depression 44 surround the opening 42 in wall 30 of the male end 8 in order to accommodate a washer (not shown).

The wings 34 are shown as separate features on each side of the ends 6, 8 but may be formed as part of a single flange extending around the whole of a lower portion of the pipe portion 4. This may be convenient when the liner sections 2 are intended to be top hung in a trench and a levelling base 50 is not required. The base 50 is also preferably formed of the same double skinned constructions as the flanges 34.

An annular seal 52 of ethylene propylene diene monomer (EDPM) or neoprene is inserted between the ends 6, 8. The seal is preferably a donut section with a hollow center to allow easy compressability to absorb tolerance variations on length. The seal 54 is trapped in the groove 24 by means of the lip 26.

In use the liner sections 2 are placed in a trench and connected together. Seals 52 are placed between adjacent ends. The wings 34 may be fastened together through holes 42 to keep them in position during the concrete pour. The screwed fixing can also be tightened to control the compression applied to the seal 52 between the sections 2.

The invention claimed is:

1. A plastics liner section for defining a drainage channel when placed end to end, the plastics liner section comprising:

an end having a flange at each side of the end adapted to butt up to a similar flange at an adjacent end of a next section, wherein the flanges are each hollow and defined by two spaced wall portions joined together by a side wall, a first end wall and a second end wall.

2. A plastics liner section as claimed in claim 1, wherein a single flange extends around a lower portion of each end.

3. A plastics liner section as claimed in claim 1, wherein the flanges are constructed as separate wings on each side of the end.

4. A plastics liner section as claimed in claim 1, wherein a hollow box section surrounds each end of the liner section.

5. A plastics liner section as claimed in claim 1, wherein a lip is formed at one end inside the flange and a groove is formed at the other end.

6. A plastics liner section as claimed in claim 5, wherein the lip and the groove are each supported on a box section that surrounds the end of the liner section.

7. A plastics liner section as claimed in claim 5, wherein the groove is sized to receive a hollow annular seal, which is retained in place by the lip.

8. A plastics liner section for defining a drainage channel when placed end to end, the plastics liner section comprising:

an end having a flange at each side of the end adapted to butt up to a similar flange at an adjacent end of a next section, wherein the flanges are each defined by two spaced wall portions joined together by a side wall, a lip is formed at one end inside the flange and a groove is formed at the other end, and the lip and the groove are each supported on a corresponding box section that surrounds each corresponding end of the liner section.

9. A plastics liner section as claimed in claim 8, wherein each of the flanges are hollow.

10. A plastics liner section as claimed in claim 8, wherein a single flange extends around a lower portion of each end.

11. A plastics liner section as claimed in claim 8, wherein the flanges are constructed as separate wings on each side of the end.

12. A plastics liner section as claimed in claim 8, wherein the groove is sized to receive a hollow annular seal, which is retained in place by the lip.

* * * * *